US005331917A

United States Patent [19]

Magers

[11] Patent Number: 5,331,917

[45] Date of Patent: Jul. 26, 1994

[54] PRIVACY ENCLOSURE AND ENTRYWAY FOR A BOAT

[75] Inventor: Mark S. Magers, Lebanon, Mo.

[73] Assignee: Outboard Marine Corporation, Waukegan, Ill.

[21] Appl. No.: 75,072

[22] Filed: Jun. 10, 1993

[51] Int. Cl.[5] ..... B63B 17/00

[52] U.S. Cl. ..... 114/361; 114/364

[58] Field of Search ..... 114/117, 343, 361, 362, 114/364; 4/449, 460, 476, 599

[56] References Cited

U.S. PATENT DOCUMENTS

| | | | |
|---|---|---|---|
| 1,008,957 | 11/1911 | Cox | 4/599 |
| 1,629,362 | 5/1927 | Robert . | |
| 1,841,002 | 1/1932 | Bell . | |
| 1,935,948 | 11/1933 | Hyrup . | |
| 2,770,244 | 11/1956 | Carson . | |
| 2,926,677 | 3/1960 | Lalonde . | |
| 3,002,518 | 10/1961 | Maxwell . | |
| 4,091,484 | 5/1978 | Means | 296/136 X |
| 4,883,016 | 11/1989 | Larson | 114/364 X |
| 5,029,348 | 7/1991 | Boren | 4/449 |

OTHER PUBLICATIONS

"1993 Sanpan Aqua Patio Sweetwater", Godfrey Marine, Elkhart, Ind. 46516.

*Primary Examiner*—Sherman Basinger

*Attorney, Agent, or Firm*—Outboard Marine Corporation

[57] ABSTRACT

The invention provides a privacy enclosure and entryway for a boat having a hull and a substantially planar deck mounted on the hull. The privacy enclosure and entryway comprises a first railing extending along at least a portion of the periphery of a first side of the deck with the first railing having an end, a second railing extending along at least a portion of the periphery of a second side of the deck, the second railing being substantially perpendicular to the first railing at the end, a door in the second railing adjacent the end, and a pivotable ledge mounted on the first railing adjacent the end and adapted to allow ingress to and egress from the deck through the door when pivoted in a vertical upright orientation and block ingress to and egress from the deck when pivoted in a horizontal lowered orientation.

17 Claims, 3 Drawing Sheets

PRIVACY ENCLOSURE AND ENTRYWAY FOR A BOAT

BACKGROUND OF THE INVENTION

Many boats, such as aluminum pontoon boats, have a planar deck and an open-type seating arrangement with no cabin or covered recess in the deck. The lack of a cabin or recess creates opportunities for proper placement of a privacy enclosure for a head.

Pontoon boats are characterized by a generally planar deck substantially surrounded by a railing around the peripheral edge. Ingress to and egress from the boat is provided by doors spaced throughout the railing.

One place it is especially advantageous to have a door is in the aft end of the pontoon boat. A door in this location allows access to the outboard motor for repair thereof and also allows access to an optional swim ladder that could depend from the aft of one of the pontoons. The aft and of the boat is an expedient position for a swim ladder in that this location is the least likely to allow for damage of the swim ladder due to docking or other maneuvering of the boat.

Since space is limited on a pontoon boat, it would be advantageous to use the same space for an entryway and a privacy enclosure. The present invention uniquely allows for this dual use of space.

Attention is directed to the following patents:

| PAT. NO. | ISSUE DATE | TITLE |
|---|---|---|
| 1,629,362 | 5/17/27 | FOLDABLE WARDROBE |
| 1,841,002 | 1/12/32 | DRESSING TENT FOR VEHICLES |
| 1,935,948 | 11/21/39 | COLLAPSIBLE DRESSING CABINET |
| 2,770,244 | 11/13/56 | PORTABLE DRESSING ROOM |
| 2,926,677 | 3/1/60 | TENT ATTACHMENT FOR AUTOMOBILES |
| 3,002,518 | 10/3/61 | PORTABLE AND COLLAPSIBLE AUTO DRESSING SCREEN |
| 4,091,484 | 5/30/78 | COLLAPSIBLE BOAT CANOPY AND STORAGE COMPARTMENT THEREFOR |
| 5,029,348 | 7/9/91 | HEAD CONSTRUCTION FOR A PONTOON BOAT |
| 5,209,177 | 5/11/93 | PONTOON-TYPE BOAT |

SUMMARY OF THE INVENTION

The invention provides a boat comprising a substantially planar deck, a hull supporting the deck, a railing extending around the periphery of the deck, the railing having an aft section, a side section, and a corner section connecting the aft section and the side section, a door in one of the railing aft section and side section adjacent the corner section, the door swinging on a vertical axis, a ledge mounted to pivot on a horizontal axis on the other of the railing side section and aft section in proximity to the corner section and the door, the ledge pivoting from a horizontal orientation to a vertical upright orientation and the ledge having a bottom surface. A U-shaped curtain rod adapted to hold a curtain is pivotally attached to the ledge bottom side for pivoting from a closed condition substantially parallel to the ledge bottom side to an open position perpendicular to the ledge bottom side.

In one embodiment, the door is in the aft section of the railing.

In one embodiment, the boat also has a shelf extending horizontally forwardly from the aft railing with a lateral end adjacent the door. The lateral end, door and side railing partially enclose a first deck portion. The pivoting ledge covers the first deck portion when the pivoting ledge is in its horizontal orientation.

In one embodiment, the lateral end also has a lip for supporting the pivoting ledge when the pivoting ledge is in its horizontal orientation.

In one embodiment, the boat also has a first collapsible support to hold the ledge in the vertical orientation and a second collapsible support to hold the curtain rod in the perpendicular open position.

In a preferred embodiment, the invention provides a curtain depending from the curtain rod. The curtain encloses the first portion of the deck when the curtain rod is in the open position and the ledge is in the vertical orientation. A head may be mounted on the first portion of the deck.

In one embodiment, the first portion of the deck defines an entryway when the ledge is in the raised vertical position and the curtain rod is in its closed position.

The invention also provides a privacy enclosure and entryway for a boat having a hull and a substantially planar deck mounted on the hull. The privacy enclosure and entryway comprises a first railing extending along at least a portion of the periphery of a first side of the deck with the first railing having an end, a second railing extending along at least a portion of the periphery of a second side of the deck, the second railing being substantially perpendicular to the first railing at the end, a door in the second railing adjacent the end, and a pivotable ledge mounted on the first railing adjacent the end and adapted to allow ingress to and egress from the deck through the door when pivoted in a vertical upright orientation and block ingress to and egress from the deck when pivoted in a horizontal lowered orientation.

In one embodiment, the door pivots about a vertical axis and the ledge pivots about a horizontal axis.

In one embodiment, the privacy enclosure and entryway also provides a head mounted on the deck wherein the head is below the ledge when the ledge is in the horizontal lowered orientation. The privacy enclosure and entryway also may have a curtain foldably mounted on the ledge wherein the curtain can be unfolded to enclose the head when the ledge is in the vertical upright orientation.

In one embodiment, the curtain is suspended from a curtain rod and the curtain rod is pivotable from a first position parallel to the ledge bottom side to a second position perpendicular to the ledge bottom side.

Other features and advantages of the invention will become apparent to those skilled in the art upon review of the following Description of the Drawings, Description of the Preferred Embodiment, Claims and Drawings.

Figure 1:
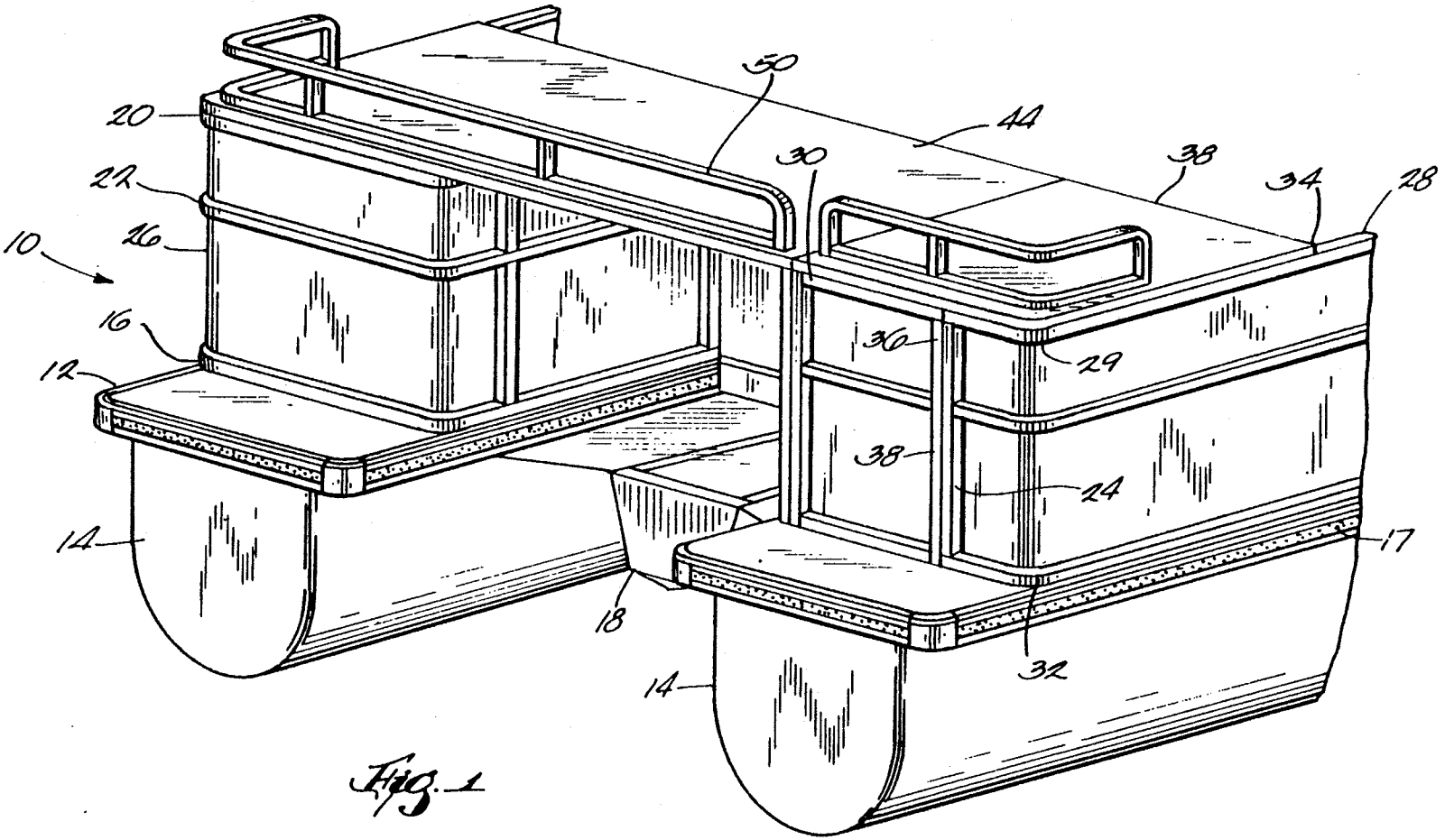
FIG. 1 is a rear elevational perspective view of a pontoon boat embodying the invention.

Before one embodiment of the invention is explained in detail, it is to be understood that the invention is not limited in its application to the details of construction and the arrangements of components set forth in the following Description or illustrated in the drawings. The invention is capable of other embodiments and of being practiced or being carried out in various ways. Also, it is to be understood that the phraseology and terminology is for the purpose of description and should not be regarded as limiting.

DESCRIPTION OF THE PREFERRED EMBODIMENT

Illustrated in the drawings is a pontoon boat 10 embodying the invention. Although the embodiment shown is used on a pontoon boat, it should be appreciated that the invention can be used in conjunction with other types of boats, especially boats having railings around their periphery and ingress to and egress from the boats provided by doors in the railing.

As best shown in FIG. 1, the pontoon boat comprises a substantially planar deck 12. Although other means are available, supporting the deck above the water in the preferred embodiment are a pair of pontoons 14. The deck 12 also comprises an outer periphery 16 to which a rub rail 17 is attached. Between the pontoons and suspended from the deck near its aft end is an outboard motor pod 18 adapted to hold an outboard motor (not shown) for propelling the boat through the water.

Around at least a portion of the outer periphery 16 of, and mounted on the deck 12, is a railing 20. In the preferred embodiment, the railing comprises a series of horizontal 22 and vertical 24 tubes welded together and bent into the proper shape. Preferably, sheeting 26 is attached thereto to fill in the voids between the tubes. This general type of railing is typical of many pontoon boats and is well known in the art.

In the preferred embodiment of the invention, the railing comprises a first side railing section 28 having an aft end 29 and a second aft railing section 30, with the two railing sections 28 and 30 connected in an aft corner of the pontoon boat by an aft railing corner section 32. In a preferred embodiment, the top of the railing 34 is about 36" above the deck 12. In a preferred embodiment, the aft section 30 is generally perpendicular to the side section 28.

Also in the aft section 30 of the railing is a door 36. The door 36 swings about a vertical axis 38, and as can be seen in the drawings, the door is generally adjacent the corner section 32 and the aft end 29 of the first side railing section 28. In a preferred embodiment, the door 36 swings outwardly to allow persons to pass from inside the railing to outside the railing. As described earlier, a door in the aft end of the boat is advantageous in that it allows persons to step onto the portion of the deck at the very back of the boat to service the outboard motor mounted on the motor pod 18. In addition, persons may have access to a swim ladder mounted on the aft of the boat. Having the swim ladder mounted on the aft of the boat reduces the chances that it will be damaged when the boat is being docked which can happen if the ladder is mounted in the front or on the sides of the boat.

Figure 6:
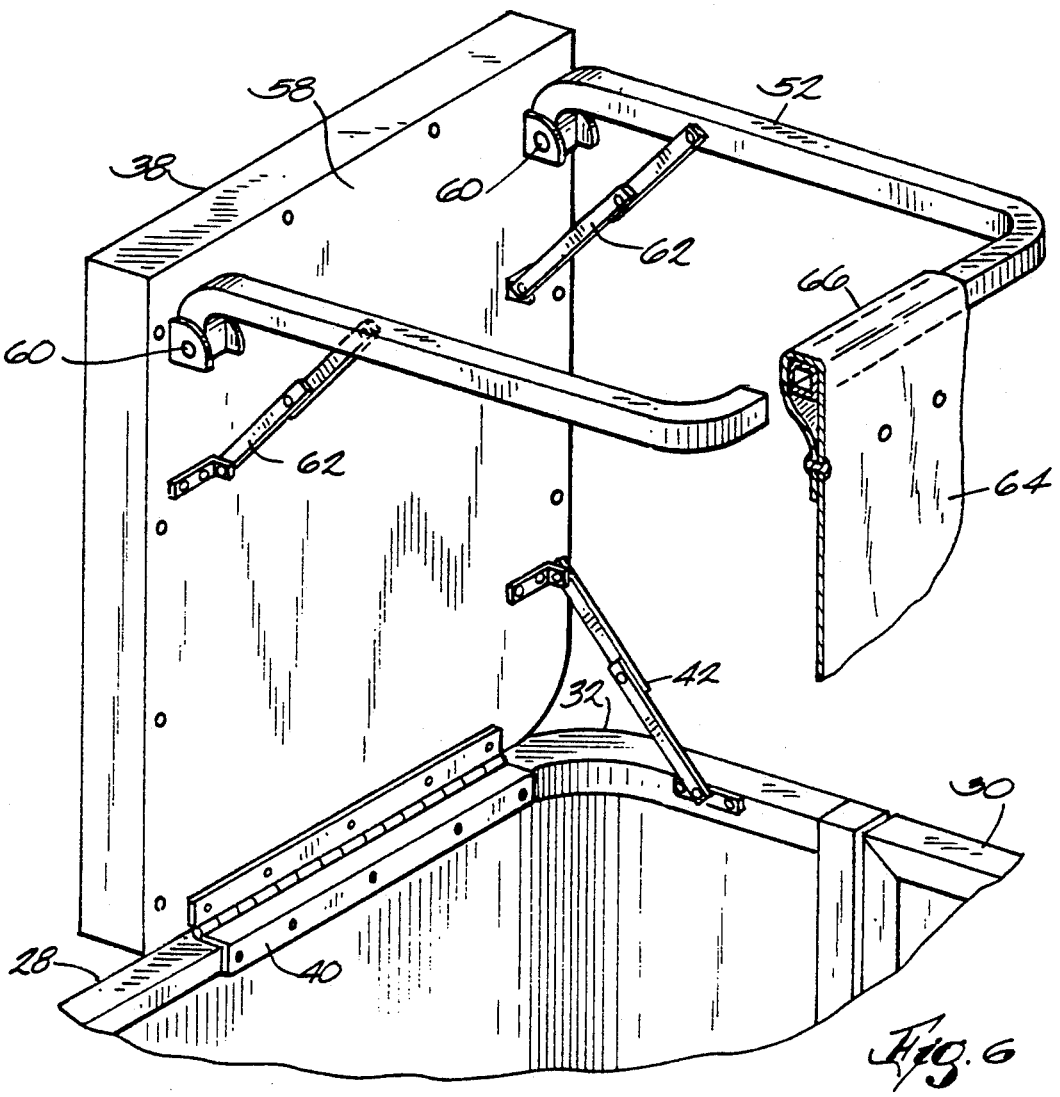
FIG. 6 is a detailed view, partially broken away of FIG. 5.
Figure 7:
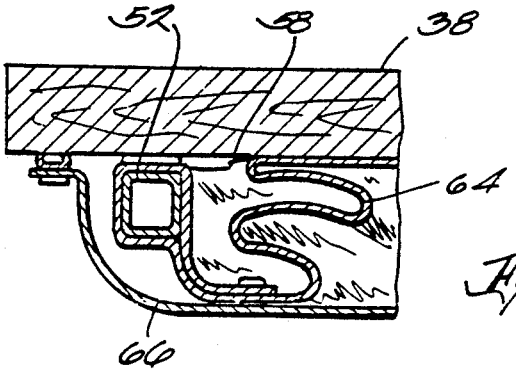
FIG. 7 is a view taken along line 7—7 of FIG. 2.

The invention also provides a pivotable ledge 38 mounted on the rearward portion of the first side railing section 28. As seen in FIG. 6, a preferred means for mounting the ledge to the railing is a hinge 40 and a first collapsible support 42.

Figure 2:
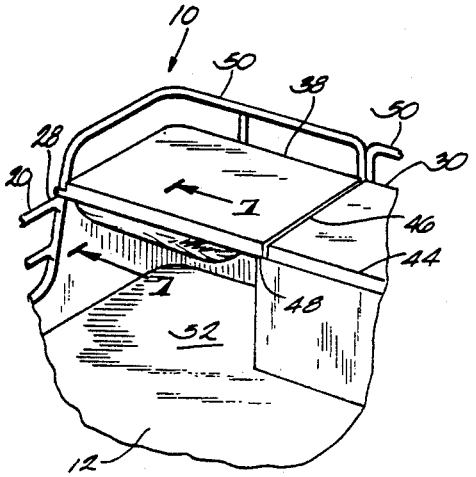
FIG. 2 is a perspective view looking rearwardly of the entryway and privacy enclosure with the ledge in the closed horizontal orientation.
Figure 3:
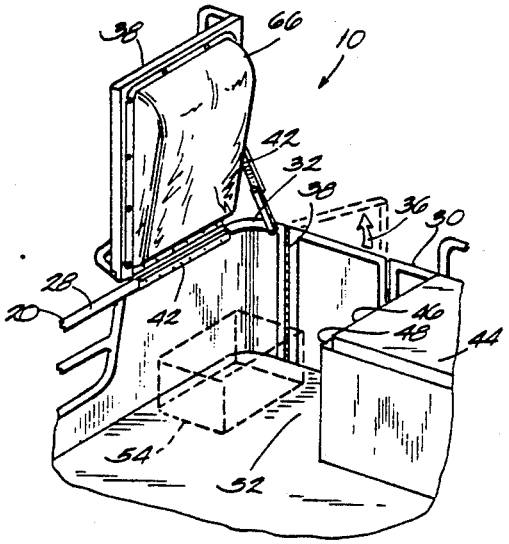
FIG. 3 is a perspective view looking rearwardly of the entryway and privacy enclosure with the ledge in the vertical upright orientation.

The ledge 38 is adapted to pivot from a first vertical upright orientation as seen in FIGS. 3 through 6 to a second closed horizontal orientation as seen in FIGS. 1 and 2. While in the horizontal orientation as seen in FIGS. 1 and 2 the ledge is disposed immediately in front of the door 36. When in the vertical upright orientation, the ledge 38 can be selectively supported by the support 42 so that it will not inadvertently pivot to the closed position. The support 42 is preferably pivotally attached to the bottom side 58 of ledge 38 and the aft railing section 30 immediately adjacent the corner section 32. Support 42 has a locking member in its middle.

Extending forwardly from the second aft railing section 30 inboard of the door 36 is a shelf 44. This shelf is generally horizontal and at approximately the same height as the top of the railing 20. The shelf 44 has a lateral end 46 which has a lip 48. The lip 48 is adapted to support the ledge 38 when the ledge 38 is in the closed or horizontal orientation.

In a preferred embodiment, the shelf 44 and the ledge 38 may also have a short upstanding outer railing 50.

The lateral edge 46 of the shelf 44, the door 36 and the aft portion of the first side railing section 28 partially surround a first deck portion 52. Preferably, mounted in one area of this deck portion is a portable head 54. In a preferred embodiment, the head is self-contained and thus can be selectively positioned in the section or removed according to the operator's desire.

When the ledge 38 is in the horizontal closed orientation, it extends over the head 54. However, when the ledge 38 is lockably supported in the upright vertical orientation, the head is accessible for use. In addition, the first portion of the deck 52 is larger than the head 54. Accordingly, when the ledge 38 is in the vertical upright orientation, there is also access to the door 36 to allow ingress to and egress from inside the boat through the door 36 and along that portion of the railing.

Pivotally mounted to the bottom side 58 of the ledge 38 is a curtain rod 56. In a preferred embodiment, the curtain rod is U-shaped with the two ends pivotally mounted to the bottom side 58 of the ledge. In this embodiment, the ends are pivotally attached to the bottom side by hinges 60. The curtain rod is also preferably supported by a pair of second supports 62. These supports can be selectively lockably operated to hold the curtain rod in a position that is perpendicular to the bottom side of the ledge or collapsed to allow the curtain rod to lay parallel to the bottom side of the ledge.

Figure 5:
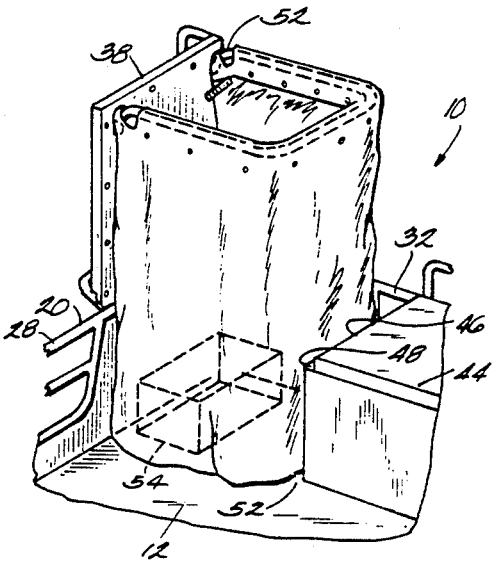
FIG. 5 is a perspective view looking rearwardly of the entryway and privacy enclosure with the ledge in the vertical upright position and the curtain rod extending perpendicularly to the bottom of the ledge.

Slidably attached to the curtain rod is a curtain 64. In a preferred embodiment, the curtain 64 has an upper portion 66 that surrounds the curtain rod 56. The curtain 64 has sufficient length that it extends from the curtain rod 56 to the deck 12 when the curtain rod is in the open perpendicular position and the ledge is in the vertical upright orientation. As seen in FIG. 5, when the above condition occurs, the curtain creates an enclosure on three sides with the ledge 38 (now in its vertical orientation) and rear portion of the side railing 28 comprising the fourth side. This allows for privacy for a person using the head.

The invention also comprises a curtain cover 66 which can selectively cover the curtain rod 56 and the curtain 64 when the curtain rod is in the closed position parallel to the bottom surface 58 of the ledge 38. This keeps the curtain out of the way of persons who are passing through the first deck portion to go in and out of the door 36, when the ledge is in the vertical orientation or aft of the head 54 or when the ledge 38 is in the closed horizontal orientation.

Describing FIGS. 2 through 5, when the boat is being propelled through the water on a lake or the like, the ledge 38 will most often be in the horizontal closed orientation with the cover 66 wrapped around the curtain and possibly a head 54 beneath the ledge on part of the first portion 52 of the deck 12.

If someone wishes to enter or leave the boat by means of the rear door 36, the ledge 38 can be pivoted upwardly and the first support 42 locked in position to hold the ledge upwardly. Persons can then enter and leave via the door 36.

Figure 4:
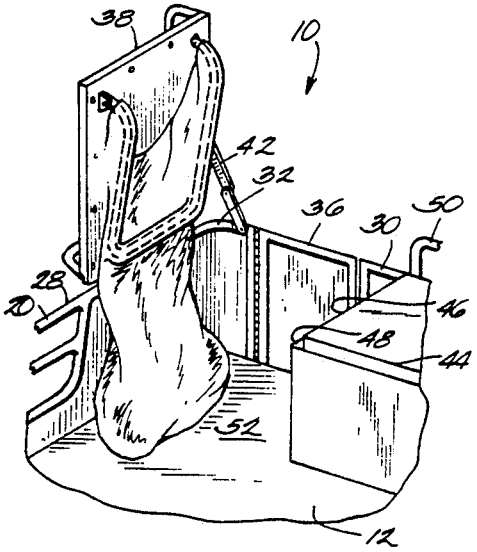
FIG. 4 is a perspective view looking rearwardly of the entryway and privacy enclosure also with the ledge in the vertical upright orientation and the curtain cover undone.

If someone were to wish to use the head 54 in privacy, first, as seen in FIG. 4, the cover 66 would be removed from the under side 58 of the ledge 38. Then the curtain rod 56 would be pivoted outwardly to a perpendicular orientation to the ledge 38 (which is in a vertical orientation) and held in this position by the second supports 62. The curtain would then be placed around the head 54 so that it could be used in privacy.

Various modes of carrying out the invention are contemplated as being within the scope of the following claims particularly pointing out and distinctly claiming the subject matter which is regarded as the invention.

I claim:

1. A boat comprising a substantially planar deck, a hull supporting the deck, a railing extending around at least a portion of the periphery of said deck, said railing having an aft section, a side section, and a corner section connecting said aft section and said side section, a door in one of said railing aft section and side section adjacent said corner section, said door swinging on a vertical axis, a ledge mounted to pivot in a horizontal axis on the other of said railing side section and aft section in proximity to said corner section and said door, said ledge pivoting from a horizontal orientation to a vertical upright orientation, said ledge having a bottom surface, a U-shaped curtain rod adapted to hold a curtain pivotally attached to said ledge bottom side for pivoting from a closed condition substantially parallel to said ledge bottom side to an open position perpendicular to said ledge bottom side.

2. The boat of claim 1 wherein said door is in said aft section of said railing.

3. The boat of claim 2 also having a shelf extending horizontally forwardly from said aft railing and having a lateral end adjacent said door, said lateral end, said door and said side railing partially enclosing a first deck portion, said pivoting ledge covering said first deck portion when said pivoting ledge is in said horizontal orientation.

4. The boat of claim 3 wherein said lateral end also has a lip supporting said pivoting ledge when said pivoting ledge is in said horizontal orientation.

5. The boat of claim 3 also having a first collapsible support to hold said ledge in said vertical orientation, said first support pivotally attached to said aft railing and said ledge bottom side.

6. The boat of claim 5 also having a second collapsible support to hold said curtain rod in said perpendicular open position, said second support pivotally attached to said curtain rod and said ledge bottom side.

7. The boat of claim 5 wherein said first portion of said deck defines a boat entryway when said ledge is in said raised vertical position and said curtain rod is in said closed position.

8. The boat of claim 3 also having a curtain depending from said curtain rod when said rod is in said perpendicular open position.

9. The boat of claim 8 wherein said curtain encloses said first portion of said deck when said curtain rod is in said open position.

10. The boat of claim 9 also having a head mounted on said first portion of said deck.

11. The boat of claim 8 also having a curtain cover, said curtain cover adaptable to enclose said curtain when said curtain rod is in said closed position.

12. A privacy enclosure and entry way for a boat having a hull and a substantially planar deck having an outer periphery mounted on the hull, said enclosure comprising a first railing permanently mounted on at least a portion of the outer periphery of a first side of said deck, said first railing having an end, a second railing permanently mounted on at least a portion of the outer periphery of a second side of said deck, said second railing being substantially perpendicular to said first railing at said end, a door in said second railing adjacent said end, a ledge pivotably mounted on said first railing adjacent said end and adapted to allow ingress to and egress from said deck through said door when pivoted to a vertical upright orientation and block ingress to and egress from said deck when pivoted to a horizontal lowered orientation, and a support for maintaining said ledge in said vertical upright orientation.

13. The privacy enclosure and entryway for a boat of claim 12 wherein said door pivots about a vertical axis and said ledge pivots about a horizontal axis.

14. The privacy enclosure and entryway for a boat of claim 13 also having a head mounted on said deck wherein said head is below said ledge when said ledge is in said horizontal lowered orientation.

15. The privacy enclosure and entryway for a boat of claim 14 also having a curtain foldably mounted to said ledge.

16. The privacy enclosure and entryway for a boat of claim 15 wherein said curtain can be unfolded to enclose said head when said ledge is in the vertical upright orientation.

17. The privacy enclosure and entryway for a boat of claim 16 wherein said ledge has a bottom side and said curtain is suspended from a curtain rod and said curtain rod is pivotable from a first position parallel to said ledge bottom side to a second position perpendicular to said ledge bottom side.

* * * * *